US006142313A

United States Patent [19]

Young

[11] Patent Number: 6,142,313

[45] Date of Patent: Nov. 7, 2000

[54] GUN RACK

[76] Inventor: Kenneth David Young, 33 Middle Creek Road, Pomona, Queensland, 4568, Australia

[21] Appl. No.: 09/286,459

[22] Filed: Apr. 6, 1999

[30] Foreign Application Priority Data

Apr. 9, 1998 [AU] Australia ..... 39935/97
Feb. 22, 1999 [AU] Australia ..... PP8802

[51] Int. Cl.[7] ..... E05B 73/00; F41A 17/02

[52] U.S. Cl. ..... 211/4; 211/64; 70/58; 248/552; 42/70.11

[58] Field of Search ..... 211/4, 64, 124, 211/89.01; 42/94, 70.11; 248/551, 552, 223.41, 224.61, 225.11; 70/14, 18, 19, 57, 58, 158–161

[56] References Cited

U.S. PATENT DOCUMENTS

| | | | |
|---|---|---|---|
| 2,953,251 | 9/1960 | Stone et al. | 211/4 |
| 3,275,160 | 9/1966 | Zorker | 211/70.5 |
| 3,365,156 | 1/1968 | Beck | 248/224.61 X |
| 3,690,130 | 9/1972 | Eutzler | 70/18 |
| 3,999,409 | 12/1976 | Bell | 70/58 |
| 4,139,100 | 2/1979 | Reed | 211/4 |
| 4,197,951 | 4/1980 | Shassere | 211/64 |
| 4,198,026 | 4/1980 | Capulupo | 211/64 |
| 4,245,745 | 1/1981 | Verelle et al. | 211/8 |
| 4,300,690 | 11/1981 | Thomas | 211/4 |
| 4,353,521 | 10/1982 | Webb | 248/552 |
| 4,993,785 | 2/1991 | Dunand | 248/224.61 X |
| 5,076,531 | 12/1991 | Delaney | 248/552 |
| 5,109,683 | 5/1992 | Cartwright | 70/14 |
| 5,129,613 | 7/1992 | Lloyd et al. | 248/224.61 |
| 5,138,786 | 8/1992 | Fischer | 42/70.11 |
| 5,282,539 | 2/1994 | Saathoff | 211/64 |
| 5,579,923 | 12/1996 | Hemmerlein | 211/4 |
| 5,621,996 | 4/1997 | Mowl, Jr. | 42/70.11 |
| 5,675,999 | 10/1997 | Carlstrom | 70/18 |
| 5,887,730 | 3/1999 | St George | 211/4 |

FOREIGN PATENT DOCUMENTS

| | | |
|---|---|---|
| 45295/85 | 1/1986 | Australia . |
| 1 530 464 | 11/1978 | United Kingdom . |

*Primary Examiner*—Daniel P. Stodola
*Assistant Examiner*—Jennifer E. Novosad
*Attorney, Agent, or Firm*—Hoffman Wasson & Gitler PC

[57] ABSTRACT

The firearms storage device provides a security rack of a clam-shell configuration enabling firearms to be secured via trigger guards. The device can be locked by a padlock or equivalent structure and the assembly obscures the way by which the device is secured to a fixture, the bolt of a locking device and its hinge pin. A two part base facilitates the use of the device in a number of different locations.

4 Claims, 3 Drawing Sheets

GUN RACK

TECHNICAL FIELD

This invention relates to improvements in devices for securely storing firearms.

BACKGROUND ART

Many people do not wish to store weapons in large intrusive boxes, cases, cabinets, racks, armouries and safes.

There have been many methods used to secure rifles and shotguns passing bars, rods, ropes and chains through trigger guards. One such device uses resilient wire roped securely attached one end, passing through trigger firearm trigger guards and to secure the opposing end.

New Zealand Patent No. 231259 discloses a gun rack which has a base with a plurality of tubular extensions and releasable locking arm which has extending fingers for engagement with the tubular extensions. The engagement of the locking arm with the base enables the arm to be locked onto the base and at the same time covers fasteners for securing the base to a wall. The combination of the fingers and tubular extensions can be used to secure firearms via their trigger guards. The locking arm of the gun rack described is fabricated from box-section steel and can readily be damaged by the use of impact tools or leverage.

The methods and devices all have disadvantages in terms of, in overcapacity, poor security, awkwardness, high costs, and in some cases non-compliance with storage regulations.

SUMMARY OF THE INVENTION

It is one object of the present invention to provide a firearms storage device which is of improved strength and integrity, Often a firearm owner is a member of a shooting club or regularly transports firearms to other places, such as a cabin and the need to secure the firearm also exists in these situations and during transportation.

It is a further object of the present invention to provide a firearm storage device which can be semi-permanently fixed to a mounting and which enables a firearm owner to detach the device from one location and to resecure the firearm at another location.

Further objects and advantages of the present invention will become apparent from the ensuing description which is given by way of example.

DISCLOSURE OF INVENTION

According to the present invention there is provided a firearms storage device comprising a base having a firearm rest portion, apertures in the base by which the device can be fastened by fasteners to a fixture, two spaced limbs extending from the firearms portion, a closure arm which can be opened and closed on the base, said arm having one end pivotably fixed to a first of the spaced limbs and a free end adapted to be locked to a second of the spaced limbs, a plurality of dowels secured with respect to the firearm rest position and extending to the closure arm said dowels being adapted to entrap trigger guards of firearms overlying the firearm rest portion when the closure arm is in the closed position.

The base can be two parts, a first part in having apertures therein which for receiving fasteners enable the device to be secured to a fixture, and second part which is a sliding and locking fit on the first part.

The apertures in the base through which the fasteners are passed can be covered by dowels.

The apertures in the first part of the base through which the fasteners pass can be covered by the second part of the base.

The first part of the base is elongate and is provided with a longitudinal male key and the second part of the base which defines the firearm rest position has a female key slot complementary to the male key.

The first and second parts of the base can be locked together by a dowel positioned in aligned apertures in the first and second parts of the base.

The free end of the closure arm can be provided with an apertured lug and the second of the spaced limbs is provided with an apertured lug complementary to the lug of the closure arm the arrangement and construction being such that when the closure arm is in the locked position the apertures align and allow the bolt of a padlock to be fixed thereto.

The lug of the second of the spaced limbs can be provided with at least two apertures and the lug on the free end is provided with a single aperture.

The base is provided with at least one fixed dowel.

BRIEF DESCRIPTION OF THE DRAWINGS

To assist with understanding the invention, reference will now be made to the accompanying drawings which show examples of the invention, in which.

DESCRIPTION OF THE PREFERRED EMBODIMENTS

Figure 1:
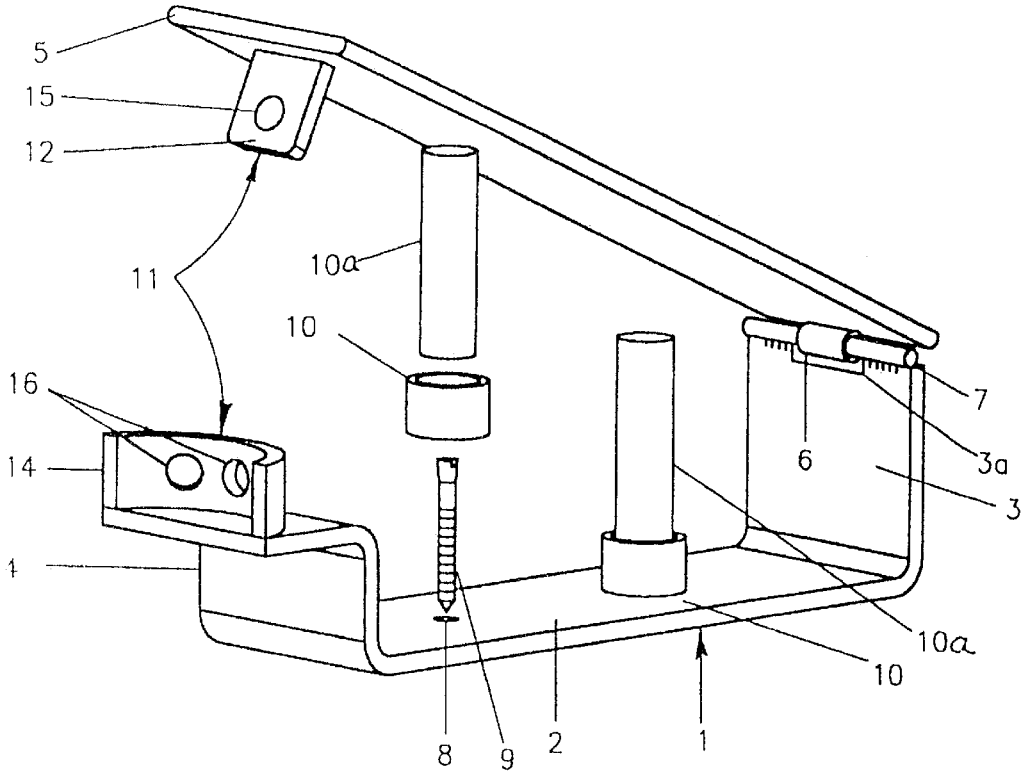
FIG. 1 shows a firearms storage device of the present invention in a partially open position.

With respect to the drawings a firearms storage device of the present invention comprises a base generally indicated by arrow 1, the base providing a firearms rest portion 2 and uprights 3, 4. A closure arm 5 is hinged to the upright 3 by a secure hinge comprising a hinge barrel 6 and a hinge pin 7 which is welded to the upright 3. A cavity 3*a* provides space for the barrel 6.

The base 1 is provided with a plurality of apertures 8 for receiving fasteners 9.

Figure 2:
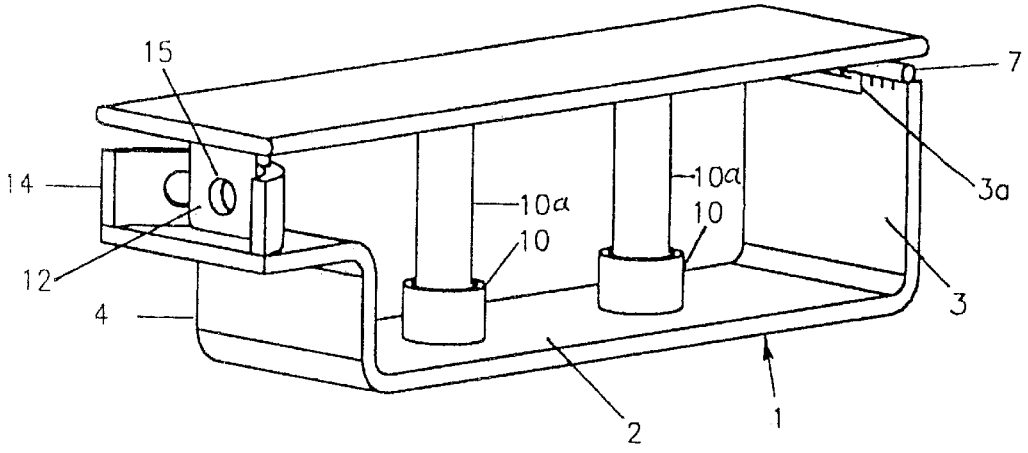
FIG. 2 shows a firearms storage device of the present invention in a closed position.
Figure 3:
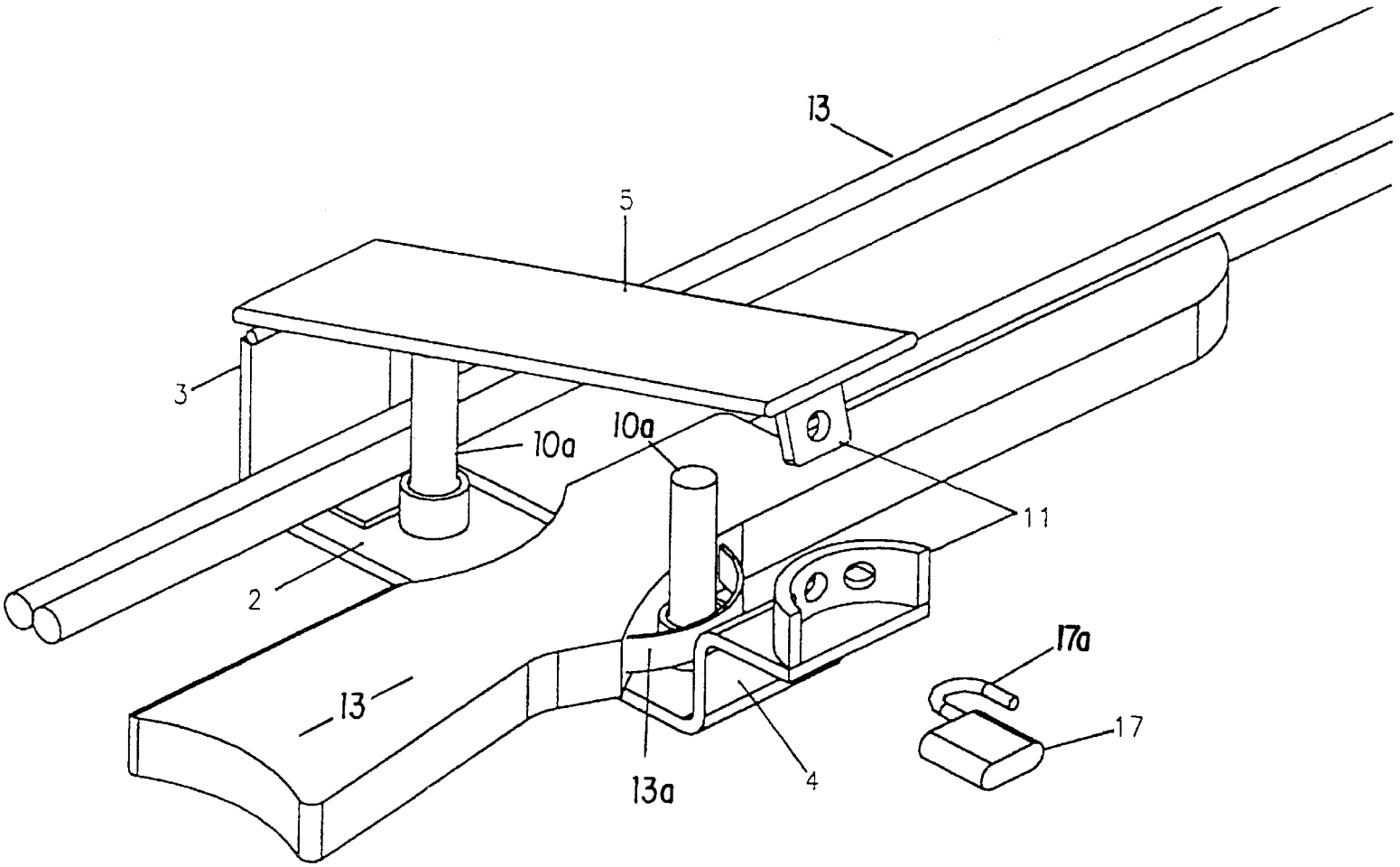
FIG. 3 shows a firearms storage device of FIG. 1 in a partially open position supporting and locking fire arms.

In the embodiment of the invention illustrated by FIGS. 1 to 3 the apertures 8 are shrouded by sleeves 10 which are fixed in position by welding screw threads or the like (not shown). Dowels 10*a* can be set in the sleeves 10 in the manner indicated.

The free end of the closure arm 5 is co-operative with a lock mounting arrangement generally indicated by arrow 11. Arm 5 is provided with an apertured lug 12, and the part of the mounting arrangement 11 associated with stopped upright 4 is provided with a complementary apertured lug 14. The lug 12 has a single aperture 15 and the lug 14 three separate apertures 16. When the arm 5 is in the closed or in a locking position (FIG. 2) the aperture 15 of the lug 12 aligns with the middle aperture 16 of the lug 14. The lug 14 is curved so that when a padlock 17 (FIG. 3) is applied to the apertures the bolt 17*a* of the padlock is shielded and inaccessible to cutting or other tools.

To secure firearms to the device the firearms can be placed on the firearm rest position 2 (FIG. 3) in the arrangement illustrated.

Where two of the devices are provided the firearms 13 can be secured by dowels 10*a* via their trigger guards 13*a* or in the instance where a set of storage devices are in close proximity, the sleeves 10 can be used as a rest for firearm barrels.

The dowels 10*a* extend fully between the rest portion 2 of the base of the device and the closure arm 5 when the arm is in its closed or locked position. The dowels 10*a* may be removable or permanently fixed with respect to the sleeves 10.

Figure 4:
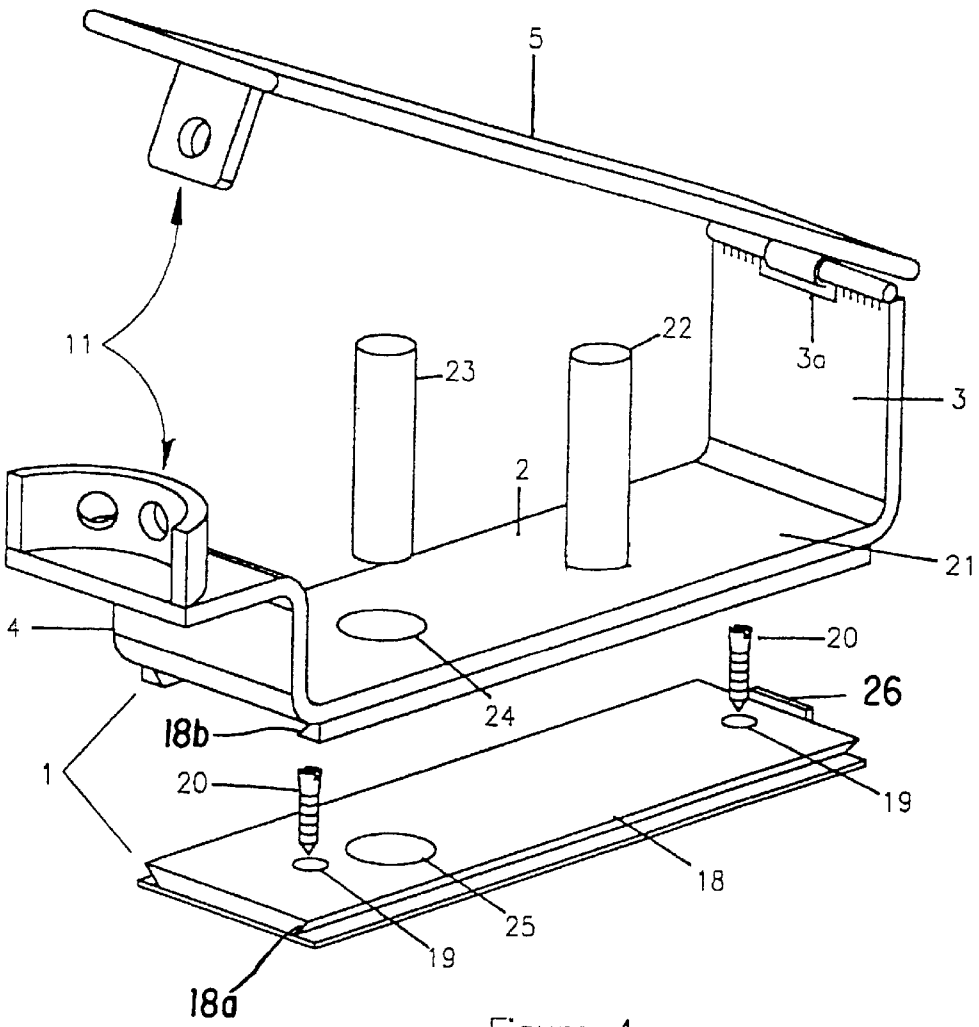
FIG. 4 shows a modified form of the device of FIG. 1.

With respect to FIG. 4 of the drawings in a modified form of the present invention the base 1 is in two parts a first part 18 having apertures 19 therein which enable it to be secured to a fixture by fasteners 20 and a second part 21 which is adapted as a sliding fit on the first part 18.

The firearm rest portion 2 of the second part 21 is slightly different than that previously described in that it is provided with one fixed dowel 22 and one removable dowel 23 which can be set in overlying apertures 24, 25 of the first and second parts of the base to lock the parts together.

In the embodiment illustrated the sliding engagement of the first and second parts 18 and 21 of the base is achieved by a 18*a* male and 18*b* female dove-tail arrangement. When correctly aligned and positioned the second part 21 of the base totally obscure the fasteners 20 used to fix the first part 18 of the base to a fixture correct alignment of the two parts of the base can be insured by a stop 26.

It is considered that the present invention has a number of advantages over the prior art devices to which I refer including the fact that all of the parts of the device that a would-be thief may perceive to be vulnerable, that is, the bolt of a lock, the hinge and the means of securement of the device to a wall or other fixture are all obscured. The device can be made from sturdy metals and be readily adapted to local regulatory requirements some of which specify minimum steel thicknesses.

Aspects of the present invention have been described by way of example only and it should be appreciated that modifications and additions may be made thereto without departing from the scope thereof as defined in the appended claims.

I claim:

1. A firearms storage device comprising a first base part having a longitudinal male key and apertures therein for receiving fasteners to enable the device to be secured to a fixture, a second base part providing a firearm rest portion and having a female keyslot which is complementary to and forms a sliding fit on the male key, two spaced limbs extending from the firearm rest portion and a closure arm which can be opened and closed above the firearm rest portion, said closure arm having one end fixed to one of the spaced limbs and a free end adapted to be locked to a second one of the spaced limbs, alignable apertures in the first and second base parts, and a removable dowel which can be secured in the alignable apertures to lock the first and second base parts together and which extends towards the closure arm to provide means for engaging the trigger guard of a firearm and to secure the firearm with respect to the storage device.

2. A firearms storage device as claimed in claim 1 wherein the free end of the closure arm is provided with an apertured lug and the second one of the spaced limbs is provided with an apertured lug complementary to the lug of the closure arm characterized in that when the closure arm is in a locked position the apertured lugs align to allow a bolt of a padlock to be fixed thereto and to be shielded by the lugs.

3. A firearms storage device as claimed in claim 2 wherein the lug of the second one of the spaced limbs is provided with at least two apertures and the lug on the free end of the closure arm is provided with a single aperture.

4. A firearms storage device as claimed in claim 1 wherein the first base part is provided with at least one fixed dowel which extends between the firearm rest portion and the closure arm.

* * * * *